US008899914B2

(12) United States Patent
Ring

(10) Patent No.: US 8,899,914 B2
(45) Date of Patent: Dec. 2, 2014

(54) STATOR VANE INTEGRATED ATTACHMENT LINER AND SPRING DAMPER

(75) Inventor: Mark David Ring, Cape Neddick, ME (US)

(73) Assignee: United Technologies Corporation, Hartford, CT (US)

( * ) Notice: Subject to any disclaimer, the term of this patent is extended or adjusted under 35 U.S.C. 154(b) by 486 days.

(21) Appl. No.: 13/343,784

(22) Filed: Jan. 5, 2012

(65) Prior Publication Data

US 2013/0177400 A1 Jul. 11, 2013

(51) Int. Cl.
*F01D 9/04* (2006.01)

(52) U.S. Cl.
USPC ..... 415/119; 415/191; 415/209.3; 415/211.2

(58) Field of Classification Search
CPC ..... F01D 9/041; F01D 9/042; F01D 25/04; F01D 25/06
USPC ..... 415/119, 191, 209.3, 211.2
See application file for complete search history.

(56) References Cited

U.S. PATENT DOCUMENTS

| | | | | |
|---|---|---|---|---|
| 3,326,523 | A | 6/1967 | Bobo | |
| 4,142,827 | A * | 3/1979 | Vinciguerra | 415/189 |
| 4,285,633 | A | 8/1981 | Jones | |
| 4,897,021 | A | 1/1990 | Chaplin et al. | |
| 5,165,848 | A | 11/1992 | Plemmons | |
| 5,429,479 | A | 7/1995 | Cordier | |
| 5,601,407 | A | 2/1997 | Humhauser | |
| 5,846,050 | A | 12/1998 | Schilling | |
| 6,139,264 | A | 10/2000 | Schilling | |
| 6,296,443 | B1 | 10/2001 | Newman et al. | |
| 6,398,499 | B1 | 6/2002 | Simonetti et al. | |
| 6,568,692 | B2 | 5/2003 | Kolodziej et al. | |
| 6,843,479 | B2 | 1/2005 | Burdgick | |
| 6,860,722 | B2 | 3/2005 | Forrester et al. | |
| 6,901,821 | B2 | 6/2005 | Torrance et al. | |
| 6,962,482 | B2 | 11/2005 | Tanaka | |
| 6,969,239 | B2 * | 11/2005 | Grant et al. | 416/220 R |
| 7,117,983 | B2 | 10/2006 | Good et al. | |
| 7,163,206 | B2 | 1/2007 | Cross et al. | |
| 7,238,003 | B2 | 7/2007 | Synnott et al. | |

(Continued)

FOREIGN PATENT DOCUMENTS

| | | |
|---|---|---|
| EP | 0781371 | 12/1998 |
| EP | 1441108 | 7/2004 |

(Continued)

OTHER PUBLICATIONS

Singapore Search & Examination Report for Application No. 201207778-0 Stator Vane Intergrated Attachment Liner and Spring Damper Feb. 9, 2013.

(Continued)

*Primary Examiner* — Ninh H Nguyen
(74) *Attorney, Agent, or Firm* — Carlson, Gaskey & Olds, P.C.

(57) ABSTRACT

A stator subassembly includes an array of circumferentially arranged stator vanes. An attachment liner secures the stator vanes to one another to provide the subassembly. A damper spring is integral with the attachment liner and is provided between the array and an outer case, which supports the array. The damper spring is configured to bias the array radially inwardly from the outer case.

15 Claims, 6 Drawing Sheets

(56) References Cited

U.S. PATENT DOCUMENTS

| | | | | |
|---|---|---|---|---|
| 7,278,821 | B1 | 10/2007 | O'Reilly et al. | |
| 7,291,946 | B2 | 11/2007 | Clouse et al. | |
| 7,445,426 | B1 | 11/2008 | Matheny et al. | |
| 8,398,366 | B2 * | 3/2013 | Twell | 415/209.2 |
| 8,419,361 | B2 * | 4/2013 | Robertson | 415/209.2 |
| 2004/0145251 | A1 | 7/2004 | Clouse et al. | |
| 2008/0279679 | A1 | 11/2008 | Morrison | |
| 2010/0068050 | A1 | 3/2010 | Hansen et al. | |
| 2013/0177401 | A1 | 7/2013 | Ring | |
| 2013/0223990 | A1 | 8/2013 | Cloarec | |

FOREIGN PATENT DOCUMENTS

| | | |
|---|---|---|
| EP | 1 657 405 B1 | 9/2011 |
| FR | 2942638 | 9/2010 |
| JP | 64-36901 | 6/1988 |
| JP | 2001-132407 | 5/2001 |
| JP | 2001-182696 | 7/2001 |
| JP | 2003-531731 | 10/2003 |
| JP | 2004-232642 | 8/2004 |
| JP | 2007332454 | 12/2007 |
| WO | 01/83157 | 11/2001 |
| WO | 2011157956 | 12/2011 |

OTHER PUBLICATIONS

European Search Report for application No. 13150309.6 completed Oct. 8, 2013 Stator Vane Spring Damper.

Non-Final Office Action for U.S. Appl. No. 13/343,808 dated Jun. 16, 2014 for Stator Vane Spring Damper.

* cited by examiner

STATOR VANE INTEGRATED ATTACHMENT LINER AND SPRING DAMPER

CROSS-REFERENCES TO RELATED APPLICATIONS

This application relates to a U.S. patent application Ser. No. 13/343,808 concurrently filed herewith entitled "STATOR VANE SPRING DAMPER."

BACKGROUND

This disclosure relates to a stator assembly for a gas turbine engine. More particularly, the disclosure relates to a damping configuration for stator vanes in the stator assembly.

Typically, gas turbine engines include a stator assembly arranged at one or more stages in the compressor section of the gas turbine engine. The stator assembly includes an array of circumferentially arranged discrete stator segments. The stator segments include an outer shroud that provides opposing hooks supported relative to an outer case. The stator segments move relative to the outer case during engine operation. Some stator assemblies have attachment liners mounted between the hooks and their supporting structure to provide a wearable structure that can be replaced.

One type of stator assembly includes an inner shroud supported at the radial innermost portion of the stator segment. The inner shrouds stabilize the stator assembly and minimize vibration. In one stator assembly configuration, an abradable seal is supported by each inner shroud to seal the compressor rotor relative to the stator assembly. A spring is arranged between the inner shroud and the seal.

Another type of stator assembly includes stator segments without an inner shroud. Individual springs are provided between the outer shroud of each stator segment and the outer case. The springs are configured to bias the stator segments radially inward. No liners may be used.

SUMMARY

An embodiment addresses a stator assembly that may include: an outer case; a stator subassembly including an array of circumferentially arranged stator vanes with each of the stator vanes having a hook. The hooks of the stator vanes may be aligned with one another. The attachment liner may secure the hooks to one another and include a damper spring integral with the attachment liner. The attachment liner may be arranged between the array and the outer case, and the damper spring is configured to bias the array radially inward from the outer case.

In a further embodiment of the foregoing stator assembly embodiment, at least one of the stator vanes may include first and second hooks. The first and second attachment liners may respectively be secured to the first and second hooks to provide the stator vane assembly. The first and second attachment liners may respectively include integral first and second damper springs.

In a further embodiment of the foregoing stator assembly embodiment, at least one of the stator vanes may include a recess having a bottom wall. The first damper spring may engage the bottom wall and may be spaced from the outer case.

In a further embodiment of the foregoing stator assembly embodiment, the first damper spring may include a first leg engaging the bottom wall. A hook at a terminal end of the first leg may be arranged opposite the first attachment liner.

In a further embodiment of the foregoing stator assembly embodiment, at least one of the stators may include an anti-rotation feature. The first leg may be arranged circumferentially adjacent to the anti-rotation feature. The first leg may include a circumferential width that is less than the circumferential width of the first attachment liner.

In a further embodiment of the foregoing stator assembly embodiment, the second damper spring may engage the outer case and may be spaced from a bottom wall of the recess.

In a further embodiment of the foregoing stator assembly embodiment, the second damper spring may include a second leg having a bow providing a terminal end that may extend radially outward toward the outer case.

In another further embodiment of the foregoing stator assembly embodiment, the second damper spring may include notches respectively providing fingers with each finger circumferentially aligned with a stator.

In a further embodiment of the foregoing stator assembly embodiment, at least one of the stators may include an anti-rotation feature. The second damper spring may include a tab extending into the recess and cooperating with the anti-rotation feature to circumferentially align the fingers relative to the stators.

In another further embodiment of the foregoing stator assembly embodiment, the second attachment liner may include a biasing portion arranged axially between the stators and the outer case to bias the stators axially relative to the outer case.

In another further embodiment of the foregoing stator assembly embodiment, a blade outer air seal may be secured to the outer case. The first and second channels may be provided by at least one of the blade outer air seal and the outer case. The first and second attachment liners respectively may be received in the first and second channels.

In another further embodiment of the foregoing stator assembly embodiment, the stator vane may include radially inwardly extending air foils providing a tip at an inner diameter that may be structurally unsupported relative to adjacent tips.

Another embodiment addresses a method of manufacturing a stator assembly that may include positioning stator vanes relative to one another to provide a circumferential array of stator vanes. The method may also include the step of installing an attachment liner together with an integral damper spring onto stator vane hooks to provide a subassembly of stator vanes. The method may also include a step of mounting the subassembly onto the outer case with the damper spring arranged between the subassembly and an outer case. The subassembly may be biased radially inward with the damper spring.

Another embodiment addresses a spring damper for a stator assembly that may include a generally arcuate S-shaped structure and may provide an attachment liner having a first circumferential width. A damper spring may be integral with the attachment liner and extend from a wall of the attachment liner to a hook. The damper spring may include a second circumferential width that is less than the first circumferential width.

Another embodiment addresses another damper spring for a stator assembly that may include: a generally arcuate S-shaped structure providing an attachment liner. A damper spring may be integral with the attachment liner, and the damper spring may include a leg extending from a wall of the attachment liner. The damper spring may include notches providing discrete fingers. The leg may have a bow extending radially outward, and a radially inward extending tab that may be configured to provide a circumferential locating feature.

BRIEF DESCRIPTION OF THE DRAWINGS

The disclosure can be further understood by reference to the following detailed description when considered in connection with the accompanying drawings wherein.

DETAILED DESCRIPTION

Figure 1:
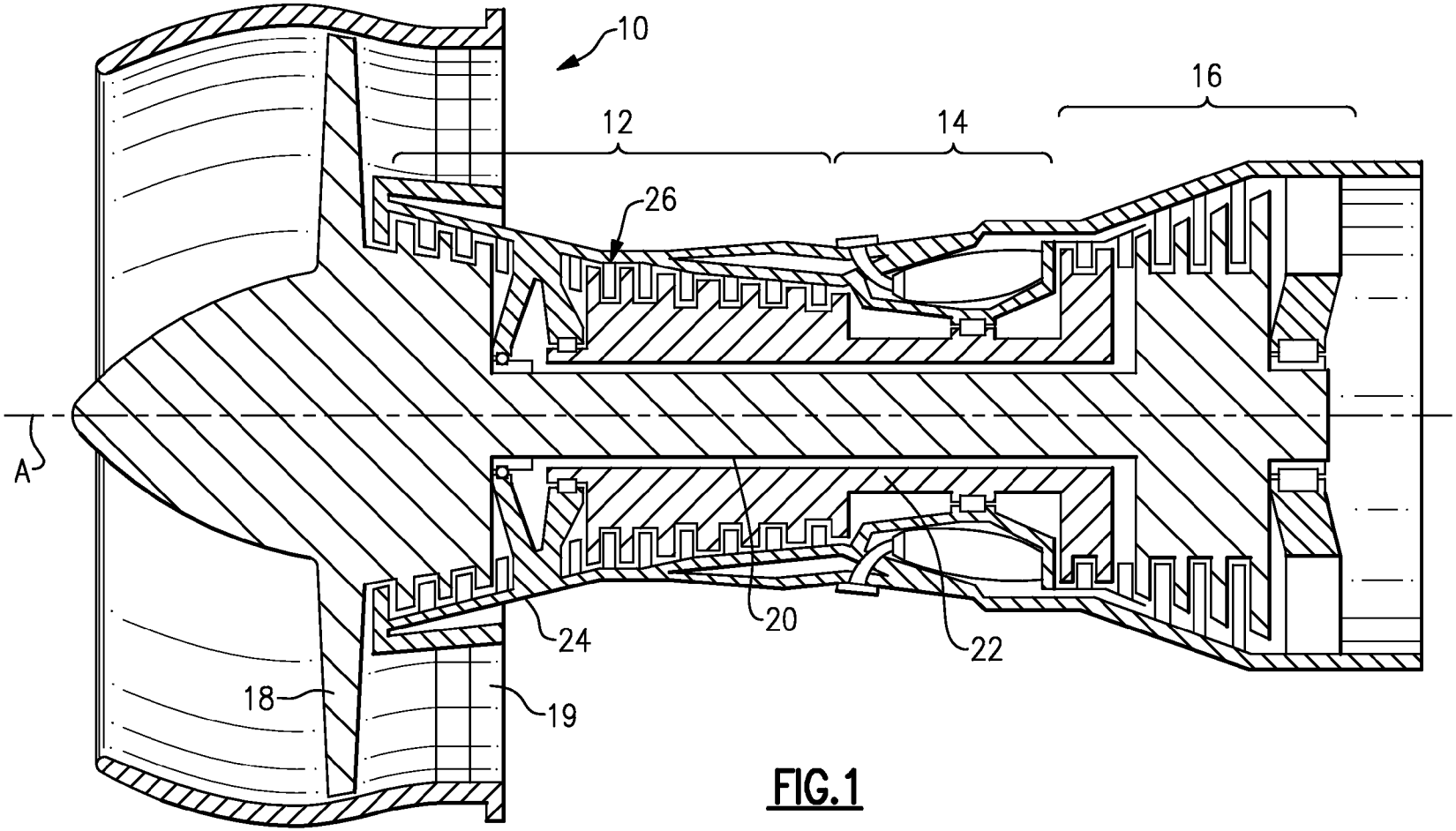
FIG. 1 is a cross-sectional schematic view of a gas turbine engine.

An example gas turbine engine 10 is schematically illustrated in FIG. 1. Although a high bypass (e.g., a bypass ratio of greater than about ten (10)) engine is illustrated, it should be understood that the disclosure also relates to other types of gas turbine engines, such as turbo jets.

The gas turbine engine 10 includes a compressor section 12, a combustor section 14 and a turbine section 16, which are arranged within a housing 24. In the example illustrated, high pressure stages of the compressor section 12 and the turbine section 16 are mounted on a first shaft 20, which is rotatable about an axis A. Low pressure stages of the compressor section 12 and turbine section 16 are mounted on a second shaft 22 which is coaxial with the first shaft 20 and rotatable about the axis A. In the example illustrated, the first shaft 20 rotationally drives a fan 18 that provides flow through a bypass flow path 19. The gas turbine engine 10 may include a geartrain (not shown) for controlling the speed of the rotating fan 18. More specifically, the geartrain may enable (e.g., using a gear reduction ratio of greater than about 2.4) a reduction of the speed of the fan 18 relative to the low compressor. The geartrain can be any known gear system, such as a planetary gear system with orbiting planet gears, a planetary system with non-orbiting planet gears or other type of gear system. The low speed second shaft 22 may drive the geartrain and the low pressure compressor. It should be understood that the configuration illustrated in FIG. 1 is exemplary only, and the disclosure may be used in other configurations.

The first and second shafts 20, 22 are supported for rotation within the housing 24. The housing 24 is typically constructed of multiple components to facilitate assembly.

An example stator assembly 26 is illustrated in FIGS. 2-5. The stator assembly 26 includes an outer case 28 that supports multiple stators 29, or stator segments, circumferentially arranged in an array. The stators 29 include an outer band 30, or shroud, that is supported by the outer case 28. An airfoil 32 extends from the outer band 30 to a tip 33, which is structurally unsupported in the example shown. This type of stator configuration is more susceptible to vibrations due to the unsupported airfoils 32 at the inner diameter of the stator assembly 26.

Each stator 29 includes first and second hooks 34, 36 that are received in corresponding first and second channels 35, 37. The channels 35, 37 may be provided in at least one of a blade outer air seal 86, the outer case 28, or both. Locating features 38 (FIG. 2) may be provided on one or more of the stators 29 to circumferentially locate the stator array relative to the outer case 28. The locating features 38 may be integral with or discrete from the stators 29.

In one example, first and second attachment liners 40, 42 are respectively secured to the first and second hooks 34, 36. The attachment liners 40, 42 join groups of stators 29 into subassemblies and provide a wearable structure between the outer shroud 30 and the outer case 28.

The stators 29 include a recess 46 that receives an arcuate damper spring 44. In the embodiments shown in FIGS. 2-6, the damper spring 44 is discrete from the attachment liners 40, 42. The damper spring 44 extends circumferentially to provide spring arcuate segments that cooperate with multiple stators 29 arranged in a subassembly. That is, a single damper spring engages at least several stators 29, biasing the array radially inward from the outer case 28. The recess 46 includes lateral walls 48, which are parallel to one another in the example, adjoining a bottom wall 50. When the stator assembly 26 is fully assembled, the damper spring 44 engages the outer case 28, the lateral wall(s) 48 and the bottom wall 50 to stabilize the stators 29 as well as to damp vibrations.

Figure 3:
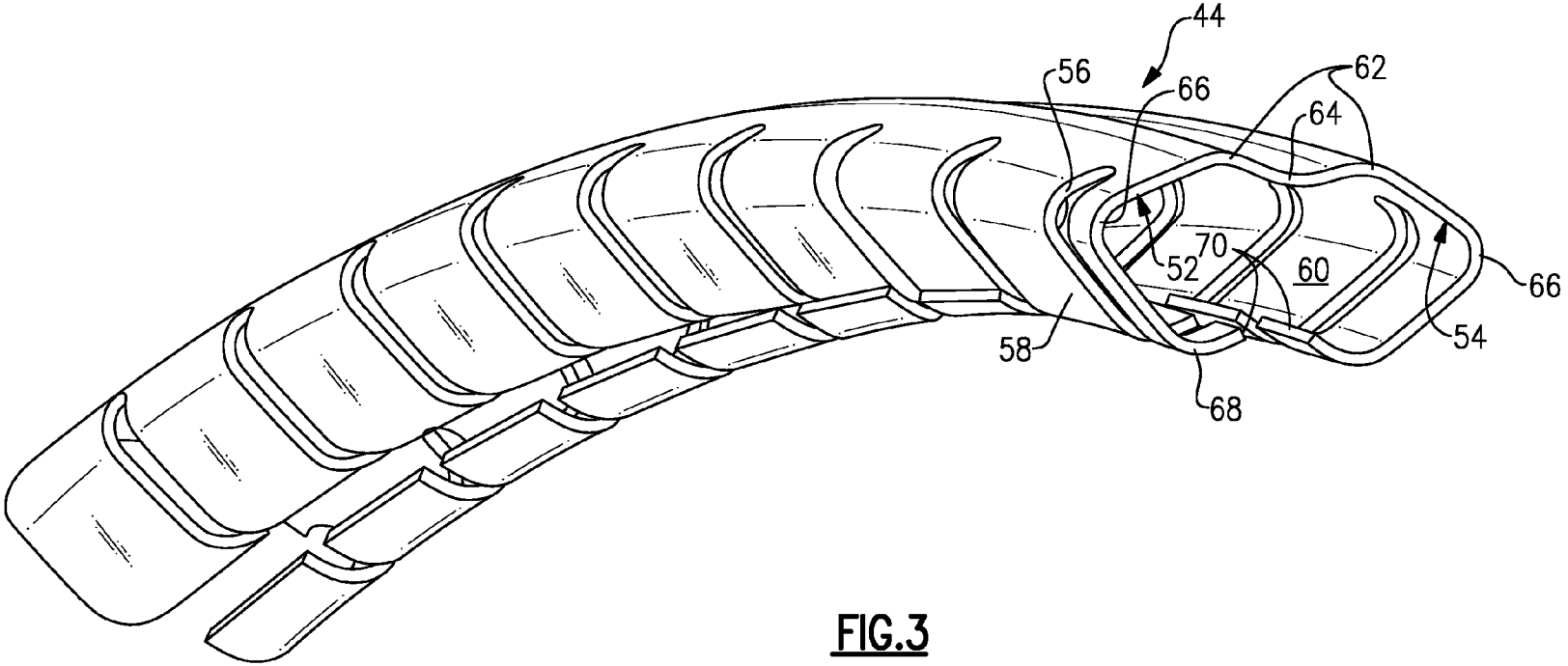
FIG. 3 is a perspective view of one example damper spring shown in the stator assembly of FIG. 2.
Figure 4:
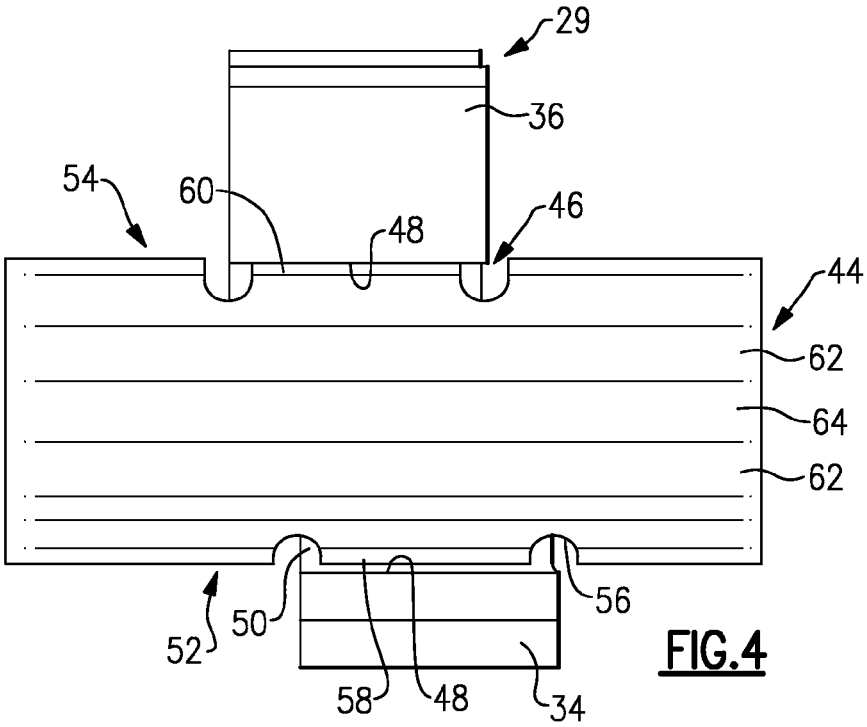
FIG. 4 is an enlarged top elevational view of the damper spring arranged within one stator segment of the stator assembly of FIG. 2.
Figure 5:
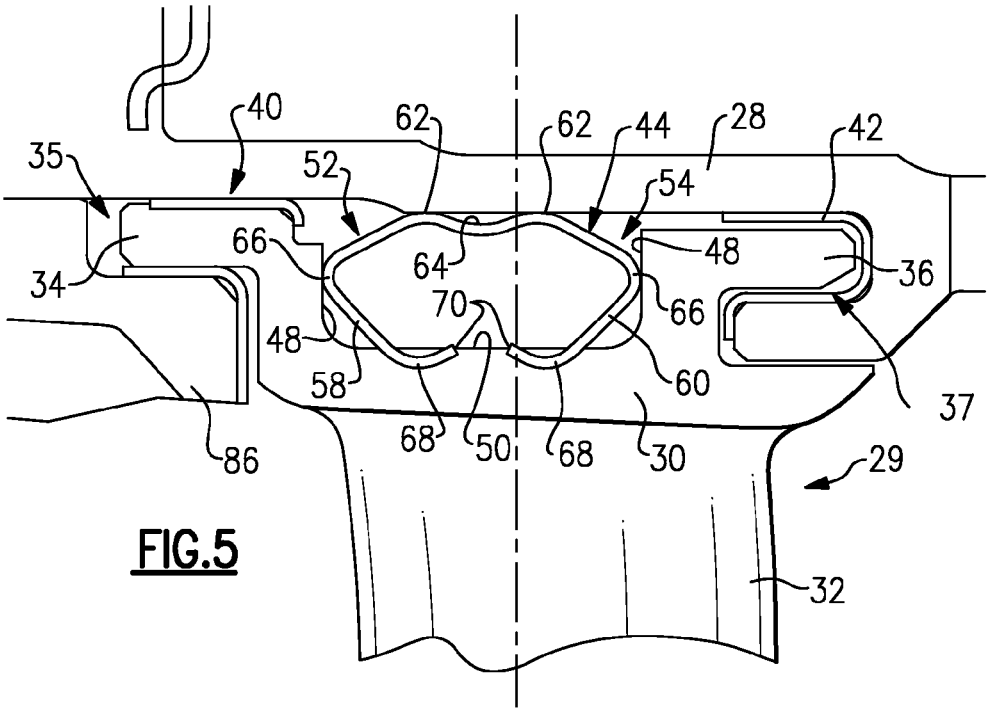
FIG. 5 is a cross-sectional view of the stator assembly illustrated in FIG. 2 with the damper spring illustrated in an uncompressed state.

Referring to FIGS. 3-5, the damper spring 44 includes symmetrically shaped first and second sides 52, 54 that provide a generally W-shaped structure. Asymmetrically oriented notches 56 are provided in the first and second sides 52, 54 to respectively provide first and second fingers 58, 60. The first fingers 58 are offset circumferentially relative to the second fingers 60, to align with and engage the first and second hooks 34, 36, which are circumferentially offset from one another, as best shown in FIG. 4. A pair of fingers 58, 60 engages each stator in the example shown.

A portion of the damper spring 44 arranged at an outer circumference includes peaks 62 providing a centrally located valley 64. Each of first and second sides 52, 54 includes a lateral bend 66 and a foot 68 extending to a terminal end 70. The feet 68 are arranged at an inner circumference of the damper spring 44. The peaks 62 engage the outer case 28 and the lateral bends 66 engage the lateral walls 48 to stabilize the stators 29. The damper spring 44 is shown in an uncompressed state in FIG. 5. In a compressed state, the feet 68 engage the bottom wall 50 and bias the stator 29 radially inward from the outer case 28. The terminal ends 70 are spaced from one another to permit compression of the first and second fingers 58, 60 during assembly.

Figure 6:
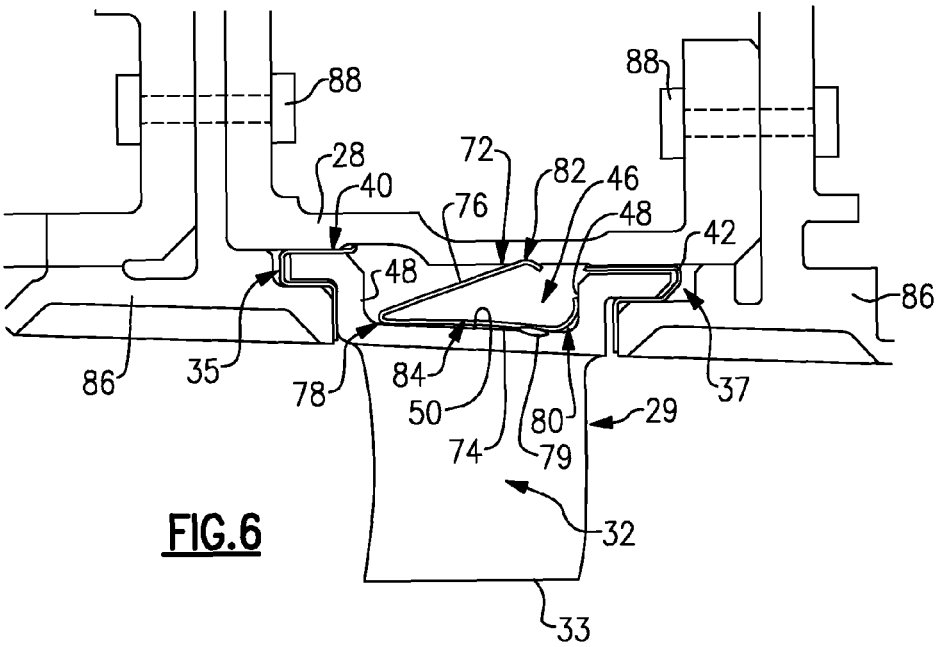
FIG. 6 is a cross-sectional view of another example damper spring.

Referring to FIG. 6, another damper spring 72 is illustrated. Like numerals are used to indicate like elements between figures. The damper spring 72 is an arcuate segment that engages multiple stators 29 and is arranged in the recess 46. The damper spring 72 provides a generally V-shaped annular structure. The damper spring 72 includes first and second legs 74, 76 joined at a first bend 78 that provides an acute angle between the first and second leg 74, 76. A second bend 80 is provided on the first leg 74 and abuts one of the lateral walls 48. A third bend 82 is provided by the second leg 76 at an outer circumference opposite the first and second bends 78, 80 and abuts the outer case 28. The first leg 74 includes a bow 84 arranged at an inner circumference, which provides two contact points (the first and second bends 78, 80) with the bottom wall 50, providing stator stability. Adhesive 79, for example, wax or hot-melt glue, may be used to secure the damper spring 72 temporarily to the stators 29 during assembly.

One or more blade outer air seals 86 may be secured to the outer case 28 by fasteners 88, as shown in FIG. 6. The first and second channels 35, 37 are provided by the outer case 28 and/or one or more blade outer air seals 86.

In one example, a method of manufacturing the stator assembly 26 includes positioning stator vanes 29 relative to one another to provide a circumferential array of stator vanes 29. In one example, the positioning step includes aligning the hooks 34, 36 relative to one another. One or more attachment liners 40, 42 are installed onto stator vane hooks 34, 36 to provide a subassembly of stator vanes 29. In one example, the installing step includes sliding the attachment liners 40, 42 over the hooks 34, 36. A damper spring 44/72 is arranged between the subassembly and the outer case 28. The subassembly is mounted onto the outer case 28 and biases the subassembly radially inward with the damper spring 44/72.

Figure 2:
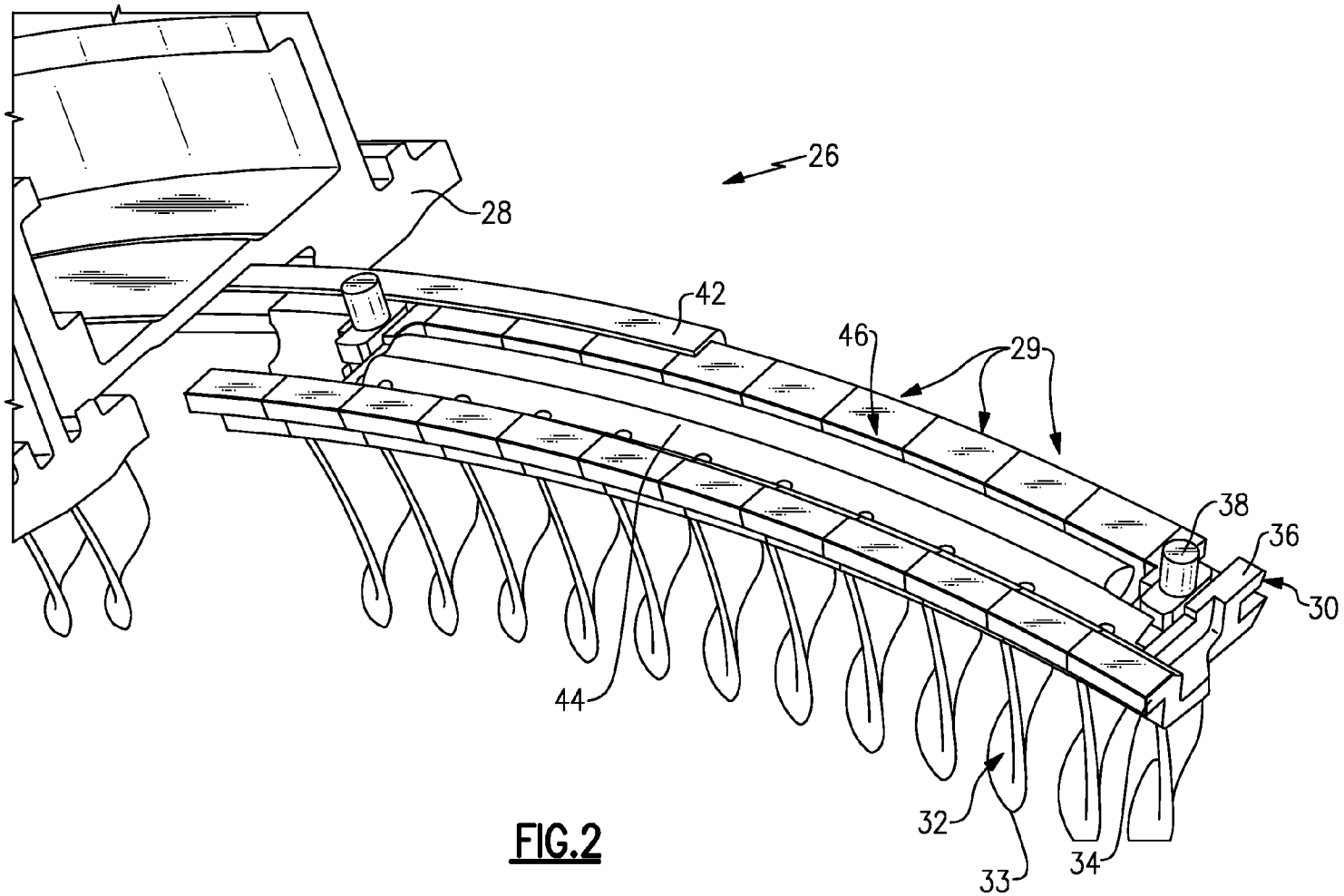
FIG. 2 is a broken, cross-sectional perspective view of a portion of a stator assembly.

In the example arrangement shown in FIGS. 2 and 5, the outer case 28 and one of the blade outer air seals are integrated with one another. This integrated structure provides the second channel 37, best shown in FIG. 5. In such a configuration, the mounting step includes sliding the second hook 36 into the second channel 37. The arrangement shown in FIG. 6 includes a configuration in which the blade outer air seal 86 is fastened to the outer case 28. For this type of configuration, the subassembly is positioned within the channels 35/37 and held between the blade outer air seal 86 and the outer case 28.

Figure 7:
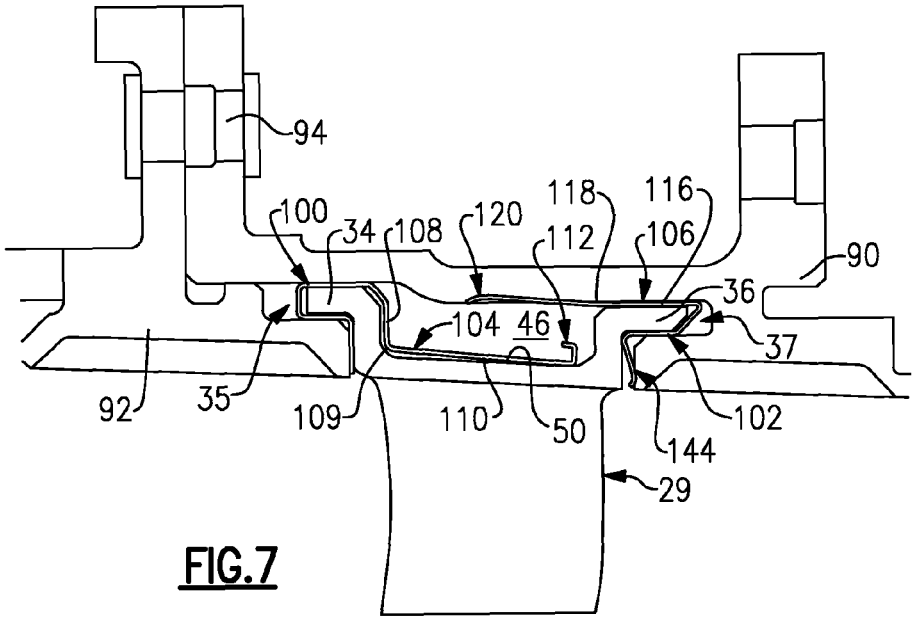
FIG. 7 is a cross-sectional view of a stator assembly with an integrated attachment liner and damper spring.
Figure 8:
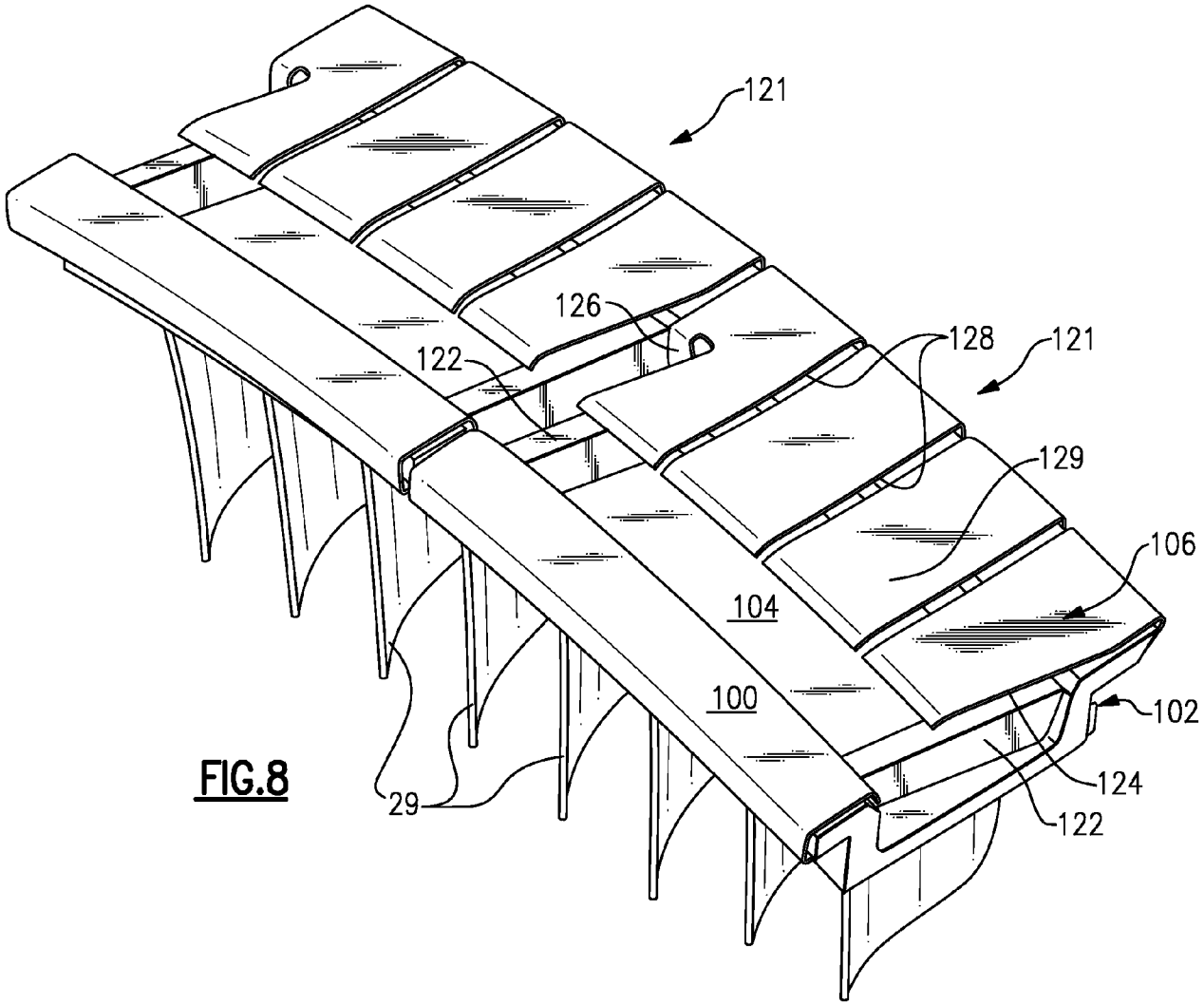
FIG. 8 is a perspective view of two stator subassemblies having the integrated attachment liner and damper spring shown in FIG. 7.

Referring to FIGS. 7 and 8, an integrated outer case and blade outer air seal 90 provides the second channel 37. Like numerals are used to indicate like elements between figures. A blade outer air seal 92 is secured to this integrated structure by fasteners 94 to provide the first channel 35. First and second attachment liners 100, 102 are secured to and wrap about the first and second hooks 34, 36. First and second damper springs 104, 106 are respectively integrated with the first and second attachment liners 100, 102. That is, each attachment liner and its corresponding damper spring are provided by a single, unitary structure that is integrally formed from a common sheet of metal, for example.

The first attachment liner 100 is generally arcuate and S-shaped and includes a first wall 108. A first leg 110 extends from the first wall 108 at a bend 109 to provide the first damper spring 104. The first leg 110 engages the bottom wall 50 of the recess 46 and is spaced from the outer case. The first leg 110 terminates in a hook 112, which may be used during assembly to position the stator vanes 29 relative to the first damper spring 104.

The second attachment liner 102 is generally arcuate and S-shaped and includes an axial biasing portion 114 arranged between the stator 29 and the integrated outer case and blade outer air seal 90. The second attachment liner 102 also includes a leg 116 providing a bow 118 extending to a terminal end 120. The leg 116 engages the outer case and is spaced from the bottom wall 50 of the recess 46.

Several stators 29 are circumferentially arranged to provide a subassembly 121, as shown in FIG. 8. One or more of the stators 29 include integrated anti-rotation features 122. The second damper spring 106 includes a tapered edge 124 that aligns with the anti-rotation feature 122. A tab 126 extending into the recess 46 and provided by the second damper spring 106 circumferentially locates the second attachment liner 102 in a desired position relative to the stators 29. Notches 128 are provided in the second damper spring 106 to provide fingers 129 aligned with each stator 29. The first damper spring 104 has a width sized to fit between the anti-rotation features 122 and is less than the width of the first attachment liner 100. Assembly is similar to that described with respect to FIGS. 2-6.

Although an example embodiment has been disclosed, a worker of ordinary skill in this art would recognize that certain modifications would come within the scope of the claims. For that reason, the following claims should be studied to determine their true scope and content.

What is claimed is:

1. A stator assembly comprising:

an outer case;

a stator subassembly including an array of circumferentially arranged stator vanes, each of the stator vanes having a hook with the hooks of the stator vanes aligned with one another; and an attachment liner securing the hooks to one another and including a damper spring integral with the attachment liner and provided between the array and the outer case, the damper spring configured to bias the array radially inward from the outer case.

2. The stator assembly according to claim 1, wherein at least one of the stator vanes includes first and second hooks, and wherein first and second attachment liners are respectively secured to the first and second hooks to provide the stator subassembly, the first and second attachment liners respectively having integral first and second damper springs.

3. The stator assembly according to claim 2, wherein at least one of the stator vanes includes a recess having a bottom wall, and wherein the first damper spring engages the bottom wall and is spaced from the outer case.

4. The stator assembly according to claim 3, wherein the first damper spring includes a first leg engaging the bottom wall, and a hook at a terminal end of the first leg opposite the first attachment liner.

5. The stator assembly according to claim 4, wherein at least one of the stators includes an anti-rotation feature, and wherein the first leg is arranged circumferentially adjacent to the anti-rotation feature, the first leg having a circumferential width that is less than the circumferential width of the first attachment liner.

6. The stator assembly according to claim 3, wherein the second damper spring engages the outer case and is spaced from a bottom wall of the recess.

7. The stator assembly according to claim 6, wherein the second damper spring includes a second leg having a bow providing a terminal end extending radially outward toward the outer case.

8. The stator assembly according to claim 6, wherein the second damper spring includes notches respectively providing fingers, each finger circumferentially aligned with a stator.

9. The stator assembly according to claim 8, wherein at least one of the stators includes an anti-rotation feature, the second damper spring includes a tab extending into the recess and cooperating with the anti-rotation feature to circumferentially align the fingers relative to the stators.

10. The stator assembly according to claim 2, wherein the second attachment liner includes a biasing portion arranged axially between the stators and the outer case biasing the stators axially relative to the outer case.

11. The stator assembly according to claim 2, comprising a blade outer air seal secured to the outer case, and first and second channels provided by at least one of the blade outer air seal and the outer case, the first and second attachment liners respectively received in the first and second channels.

12. The stator assembly according to claim 1, wherein the stator vanes include radially inwardly extending airfoils providing a tip at an inner diameter that is structurally unsupported relative to adjacent tips.

13. A method of manufacturing a stator assembly comprising the steps of:

positioning stator vanes relative to one another to provide a circumferential array of stator vanes;

installing an attachment liner together with an integral damper spring onto stator vane hooks to provide a subassembly of stator vanes; and mounting the subassembly onto the outer case with the damper spring arranged between the subassembly and an outer case, and biasing the subassembly radially inward with the damper spring.

14. A spring damper for a stator assembly comprising:

a generally arcuate S-shaped structure providing an attachment liner having a first circumferential width, a damper spring integral with the attachment liner and extending from a wall of the attachment liner to a hook, the damper spring having a second circumferential width that is less than the first circumferential width.

15. A spring damper for a stator assembly comprising:

a generally arcuate S-shaped structure providing an attachment liner, a damper spring integral with the attachment liner, the damper spring including a leg extending from a wall of the attachment liner and including notches providing discrete fingers, the leg including a bow extending radially outward, and a radially inwardly extending tab configured to provide a circumferential locating feature.

* * * * *